US006406383B2

(12) United States Patent
Moriyama et al.

(10) Patent No.: US 6,406,383 B2
(45) **Date of Patent: *Jun. 18, 2002**

(54) MULTI-PIECE GOLF BALL

(75) Inventors: Keiji Moriyama; Kazunari Yoshida, both of Akashi (JP)

(73) Assignee: Sumitomo Rubber Industries, Ltd., Kobe (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 25 days.

(21) Appl. No.: 09/353,597

(22) Filed: Jul. 15, 1999

(30) Foreign Application Priority Data

Sep. 18, 1998 (JP) ..... 10-265255

(51) Int. Cl.[7] ..... A63B 37/04; A63B 37/06

(52) U.S. Cl. ..... 473/371; 473/372; 473/373; 473/374; 473/375; 473/376; 473/377; 473/378; 473/379

(58) Field of Search ..... 473/371–379

(56) References Cited

U.S. PATENT DOCUMENTS

| | | | | | |
|---|---|---|---|---|---|
| 5,421,580 | A | * | 6/1995 | Sugimoto | 273/227 |
| 5,439,227 | A | * | 8/1995 | Egashira | 273/228 |
| 5,553,852 | A | * | 9/1996 | Higuchi | 473/373 |
| 5,704,853 | A | * | 1/1998 | Maruko | 473/363 |
| 5,711,723 | A | * | 1/1998 | Hiraoka | 473/374 |
| 5,713,802 | A | * | 2/1998 | Moriyama | 473/374 |
| 5,733,974 | A | * | 3/1998 | Yamada | 525/72 |
| 5,743,816 | A | * | 4/1998 | Ohsumi | 473/376 |
| 5,762,568 | A | * | 6/1998 | Kato | 473/365 |
| 5,766,096 | A | * | 6/1998 | Maruko | 473/365 |
| 5,772,530 | A | * | 6/1998 | Kato | 473/363 |
| 5,772,531 | A | * | 6/1998 | Ohsumi | 473/376 |
| 5,810,677 | A | * | 9/1998 | Maruko | 473/357 |
| 5,816,944 | A | * | 10/1998 | Asakura | 473/372 |
| 5,820,485 | A | * | 10/1998 | Hwang | 473/361 |
| 5,830,086 | A | * | 11/1998 | Hayashi | 473/376 |
| 5,848,942 | A | * | 12/1998 | Kato | 473/365 |
| 5,857,924 | A | * | 1/1999 | Miyagawa | 473/365 |
| 5,976,034 | A | * | 11/1999 | Kato | 473/363 |
| 5,976,035 | A | * | 11/1999 | Umezawa | 473/364 |
| 6,068,561 | A | * | 3/2000 | Renard | 473/364 |
| 6,045,460 | A | * | 4/2000 | Hayashi | 473/376 |

FOREIGN PATENT DOCUMENTS

| | | |
|---|---|---|
| JP | 08336617 A | 12/1996 |
| JP | 08336618 A | 12/1996 |
| JP | 09056848 A | 3/1997 |
| JP | 09248351 A | 9/1997 |
| JP | 09266959 A | 10/1997 |
| JP | 09299510 A | 11/1997 |

* cited by examiner

*Primary Examiner*—Peter Vo
*Assistant Examiner*—Paul Kim
(74) *Attorney, Agent, or Firm*—Birch, Stewart, Kolasch & Birch, LLP

(57) ABSTRACT

A golf ball retaining high coefficient of restitution inherent and having fine shot feeling with clubs such as drivers, irons and putters is disclosed. A multi-piece golf ball comprising; a center core having a JIS-C hardness of not more than 75, a cover having a JIS-C hardness of not less than 85, a core enclosing layer which directly enclose said center core having a JIS C hardness smaller than the others, and a r.d.preventing layer which prevents a restitution coefficient degradation being internally disposed in contact with said cover and having a JIS C hardness greater than the others.

8 Claims, 1 Drawing Sheet

MULTI-PIECE GOLF BALL

BACKGROUND OF THE INVENTION

1. Field of the Invention

The present invention relates to a multi-piece golf ball excellent in flight performance and shot feeling. More particularly it relates to a multi-piece golf ball which retains a low spin inherent in two-piece golf balls, as well as a high trajectory angle at the time of shot, and also has an improvement in shot feeling.

2. Description of the Prior Art

Conventionally thread-wound golf balls and two-piece golf balls are usually employed. In the former, a rubber thread is wound about a core which is a solid rubber ball (solid center) or a liquid-filled spherically shaped rubber envelope (liquid center), and further covered with a cover made of balata or the like. In the latter, a rubber core is covered with a cover made of a thermoplastic resin, e.g., ionomer.

Thread-wound golf balls are excellent in impact at the time of shot (which means good shot feeling) and controllability. However, since they are of structure inherently susceptible to spin, a sufficient flying distance cannot be secured in a wind ahead and they are also poor in durability. As compared with thread-wound golf balls, two-piece golf balls have superior durability and can ensure a flying distance in a wind ahead because they are not susceptible to spin and have a high coefficient of restitution. However, from the standpoint of ensuring high coefficient of restitution, the two-piece golf balls are generally hard and thus inferior in shot feeling to the thread-wound Golf balls.

As a golf ball which has improvements in shot feeling while ensuring the flight performance of two-piece golf balls, a variety of multi-piece golf balls have been proposed which comprise disposing an intermediate layer between a cover and a core, providing two or more layers of covers, providing two or more layers of cores, or a combination of these. Japanese Patent Laid-Open Nos. 33617/1996, 336618/1996, 56848/1997, 248351/1997, 266959/1997 and 299510/1997 disclose multi-piece golf balls excellent in both flight performance and shot feeling which are attained by arranging such that each layer has a hardness in a predetermined range.

The multi-piece golf balls as disclosed in the above publications are broadly classified into three groups: ones in which the outermost layer of a cover is the hardest and a soft layer is provided on the inside of the cover (e.g., 33617/1996); ones in which between a core and a cover there is disposed a core enclosing layer softer than the core (e.g., 336618/1996); and ones in which a core enclosing layer is the hardest (e.g., 266959/1997, 248351/1997).

There are, however, demands on further improvements in shot feeling and flying distance. Particularly, improvement in shot feeling is insufficient depending on the kind of club. For example, even if it is possible to reduce impact upon the shot of a golf ball by a driver or an iron when the cover is hard, the coefficient of restitution increases, but the shot feeling upon use of a putter is poor.

Accordingly, it is a primary object of the present invention to provide a golf ball which offers fine shot feeling with any kind of club, while retaining high coefficient of restitution inherent in solid golf balls.

SUMMARY OF THE INVENTION

According to a first aspect of the present invention, a multi-piece golf ball comprises a center core having a JIS-C hardness of not more than 75, a cover having a JIS-C hardness of not less than 85, a core enclosing layer which directly encloses said center core having a JIS C hardness smaller than the others, and a r.d. preventing layer which prevents a restitution coefficient degradation, being internally disposed in contact with said cover and having a JIS C hardness greater than the others.

The multi-piece golf ball of this invention further may comprise an interposing layer between the core enclosing layer and the restitution coefficient degradation preventing layer.

Another aspect of the present invention, a multi-piece golf ball comprises a center core, a core enclosing layer covering the center core, an inner cover layer covering the core enclosing layer, and an outer cover layer covering the inner cover layer. The center core has a JIS-C hardness of from 50 to 75. The core enclosing layer has a JIS-C hardness of less than 50. The inner cover layer has a JIS-C hardness of not less than 97. The outer cover layer has a JIS-C hardness of not less than 85 and less than 97.

The term "JIS-C hardness" used herein is the hardness determined with a spring hardness tester C type according to JIS(Japanese Industrial Standard)-K6301.

These and other objects, features, aspects and advantages of the present invention will become more apparent from the following detailed description of the present invention when taken in conjunction with the accompanying drawings.

DETAILED DESCRIPTION OF THE INVENTION

A golf ball of the present invention has at least 4 components as follows:

- a center core which is the central part of the golf ball;
- a core enclosing layer which directly encloses the center core;
- a cover which is the surface layer of the golf ball; and
- a restitution coefficient degradation preventing layer which is internally disposed in contact with the cover and prevents degrading a restitution property of the golf ball, hereinafter being referred to briefly as "r.d. preventing layer".

Figure 1:
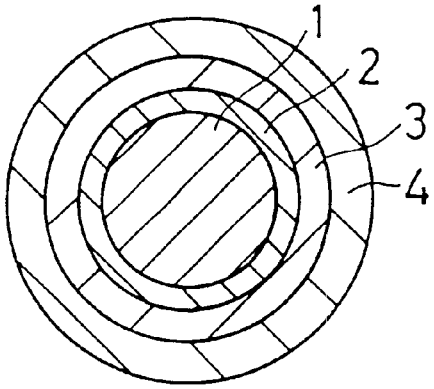
FIG. 1 is a schematic diagram illustrating the structure of a four-piece golf ball according to one preferred embodiment of the present invention.

Its typical embodiment is a four-piece golf ball, as shown in FIG. 1, which comprises a center core 1, a core enclosing layer 2, a r.d. preventing layer 3 corresponding to an inner cover layer, and a cover 4 corresponding to an outer cover layer. These components will be described from the inside out.

The center core 1 is mainly composed of rubber and has a JIS-C hardness of not more than 75. Its suitable diameter is from 29 to 38 mm, in consideration of the standard on golf ball size.

The center core 1 has a profound effect on the shot feeling of clubs, e.g., drivers and irons, in which the ball is hit at high head speed. If a core constituting a large proportion of a ball is too hard, the ball deformation by shot is suppressed. Therefore, the ball is subject to spin and is caught by wind ahead, resulting in insufficient flying distance. For this reason, it is necessary for the center core 1 to have a JIS-C hardness of not more than 75, preferably not more than 65. Further, in order to retain the shape of a solid golf ball and ensure its inherent high coefficient of restitution, it is desirable that the lower limit of the hardness of the center core 1 be set to 55. The reason why the diameter of the center core 1 is not less than 29 mm is that, below 29 mm, trajectory angle is small and thus fails to increase flying distance.

The center core 1 as described is generally composed of a vulcanization molded sphere of a rubber composition which is prepared by mixing a base rubber together with an organic peroxide as a crosslinking initiator, and an unsaturated carboxylic acid or its metal salt, as a co-crosslinking agent.

As the base rubber used in a rubber composition for core, there can be employed natural or synthetic diene rubbers which have been conventionally used in the cores of solid golf balls. Examples of synthetic diene rubbers are ethylene-propylene-diene terpolymer (EPDM), butadiene rubber (BR), isoprene rubber (IR), styrene-butadiene rubber (SBR), and acrylonitrile-butadiene rubber (NBR). They can be used singly or in a combination of two or more kinds. Of these, preferred is a so-called high cis-1,4-polybutadiene having cis structure of not less than 40%, preferably not less than 80%.

An organic peroxide is added mainly as a crosslinking initiator. Examples of organic peroxide are dicumyl peroxide, 1,1-bis(t-butyl peroxy)-3,5-trimethylcyclohexane, 2,5-dimethyl-2,5-di(t-butyl peroxy)hexane, and di-t-butyl peroxide. Preferred is dicumyl peroxide. An organic peroxide may be preferably used in the amount of 0.3 to 2.0 weight parts, more preferably 0.5 to 2.0 weight parts per 100 weight parts of a base rubber.

Examples of unsaturated carboxylic acid or its metal salt, as a co-crosslinking agent, are $\alpha,\beta$-unsaturated carboxylic acid having 3 to 8 carbon atoms, e.g., acrylic acid and methacrylic acid; and their univalent or bivalent metal salts, e.g., zinc acrylate, zinc methacrylate, magnesium acrylate or the like. Preferred is zinc acrylate which offers high coefficient of restitution. An unsaturated carboxylic acid metal salt may be preferably used in the amount of 10 to 25 weight parts, more preferably 10 to 20 weight parts per 100 weight parts of a base rubber. Above 25 weight parts, crosslinked structure is too dense to adjust the hardness to not more than 75. Below 10 weight parts, the high coefficient of restitution inherent in solid golf balls cannot be ensured.

In addition to the above essential components, usual additives to be blended with a core material for golf ball, such as specific gravity adjusting agent, antioxidant, plasticizer, dispersant, ultraviolet absorbent, colorant and peptizer, can be suitably mixed with a rubber composition for core, if required. Examples of specific gravity adjusting agents are inorganic salts such as zinc oxide, barium sulfate and calcium carbonate; hyperbaric metal powder such as tungsten and molybdenum powder; and a mixture of these.

The core enclosing layer 2 is the softest in a plurality of layers constituting a multi-piece golf ball of the present invention. Specifically, a JIS-C hardness of the core enclosing layer is preferably less than 50. Since the core enclosing layer 2 has a profound effect on the shot feeling when hit the golf ball by irons and drivers, as in the case with the center core 1, the impact at the time of shot is reduced as the layer 2 is softer. Further, the core enclosing layer 2 as well as the center core 1 is not required in a strict sense to retain its spherical shape for retaining the ball shape. Therefore, with adjustment of thickness of the layer 2, a multi-piece golf ball can be obtained, which have a restoring property and a cushioning property without exerting little or no influence on coefficient of restitution. The restoring property is such that great deformation by a driver's shot can be restored, and the cushioning property is such that impact at the time of shot is alleviated. For this reason, it is desirable that the core enclosing layer 2 has the lowest JIS-C hardness, namely, less than 50, more preferably not more than 45. Thickness of the core enclosing layer 2 is preferably about 0.5 to 2.0 mm. If the layer 2 is too thick, a golf ball becomes too soft, thereby promotes deformation of the ball. Thus it becomes difficult for such a soft golf ball to return to its original shape. To the contrary, if the layer 2 is too thin, the effect of improving shot feeling by the core enclosing layer 2 cannot be expected. When the core enclosing layer 2 with a thickness in the range of effecting shot feeling improvement, has an extremely low hardness, the high coefficient of restitution of a golf ball is lowered considerably. Therefore, the lower limit of the hardness is preferably not less than 30, more preferably not less than 40.

As to the material of the core enclosing layer 2, no special limitations are imposed thereon, and any materials satisfying the above-mentioned hardness are useable. There are, for example, a vulcanization molded sphere of a rubber composition comprising mainly rubber, a thermoplastic elastomer composition, and a mixed composition of rubber and a thermoplastic elastomer.

The aforesaid rubber composition comprises, as in the case with the rubber composition constituting the center core 1, a diene rubber as a base rubber, an organic peroxide as a crosslinking initiator, and an unsaturated carboxylic acid or its metal salt, as a co-crosslinking agent. In addition, there may be suitably blended, as required, usual additives to be blended with a core material for golf ball, such as specific gravity adjusting agent, antioxidant, plasticizer, dispersant, ultraviolet absorbent, colorant and peptizer. To achieve a hardness of less than 50, it is desirable to use polybutadiene rubber as a base rubber, and, as its crosslinking compounds, 0.5 to 2.0 weight parts of dicumyl peroxide and 5 to 10 weight parts of zinc acrylate per 100 weight parts of the base rubber.

A thermoplastic elastomer used in the present invention is a block copolymer in which a polymer block is in frozen phase or crystal phase at a temperature below its melting point, or a polymer block of hard segment whose molecular motion is limited by a hydrogen bond, is linked to a polymer block of soft segment. The polymer blocks may be linked in any form, for example, in the form of H-S, H-S-H, multi-block expressed by (H-S)n, or star shape, wherein H is a hard segment and S is a soft segment.

There are, for example, polystyrene elastomers which comprise polystyrene as a hard segment and polybutadiene, polyisoprene, or a polymer block obtained by hydrogenating them as a soft segment; polyolefin elastomers which comprise polyethylene or polypropylene as a hard segment and butyl rubber or EPDM as a soft segment; polyamide elastomers which comprise polyamide as a hard segment and polyester or polyether as a soft segment; polyester elastomers which comprise polyester as a hard segment and polyether as a soft segment; polyurethane elastomers which comprise a polyurethane block having an urethane bond as a hard segment and polyester or polyether as a soft segment; elastomers which comprise one or more epoxy groups in a polybutadiene block, or an OH group attached to the end of polystyrene block; and a mixture of two or more kinds of the above elastomers. Preferred are the polyurethane elastomers and polystyrene elastomers because a hardness of less than 50 is easily attained.

Like the rubber composition, a composition comprising mainly an elastomer can be mixed, as required, with additives such as specific gravity adjusting agent, antioxidant, plasticizer, dispersant and colorant, in proper proportions.

The r.d. preventing layer 3 is the hardest in a plurality of layers constituting a multi-piece golf ball of the present invention. The r.d. preventing layer 3 functions to compensate a decrease in coefficient of restitution which is caused by reducing the hardness of the cover 4. That is, the shot feeling with a club whose head speed at shot is very slow, e.g., putters, is significantly affected by the hardness of the cover 4 being the surface layer of the ball. In view of using the club, it is desirable that the cover 4 is as soft as possible. However, the softening of the cover 4 will lead to a reduction in coefficient of restitution, namely, a reduction in flying distance. Hence, in order to ensure the high coefficient of restitution inherent in solid golf balls, the r.d. preventing layer 3 with the highest hardness is provided on the inside of the cover 4 such that the r.d. preventing layer 3 is in contact with the cover 4. For this reason, the r.d. preventing layer 3 is required to have a JIS-C hardness higher than that of the cover 4. In order to ensure high coefficient of restitution, a hardness of not less than 97 is desirable. In consideration of the relationship with the thickness of the cover 4, the influence of the r.d. preventing layer 3 in contact with the cover 4 cannot be ignored. Thus, for ensuring the shot feeling upon use of putters, the lower limit of hardness should be not more than 100, preferably not more than 98. Thickness of the r.d. preventing layer 3 is preferably from 1.0 to 2.5 mm, such as to exhibit the effect of preventing restitution coefficient degradation.

As to the material of the r.d. preventing layer 3, no special limitations are imposed thereon, and any materials satisfying the above-mentioned hardness are useable. There are, for example, a rubber composition comprising mainly rubber, an elastomer composition comprising mainly a thermoplastic elastomer, an ionomer composition comprising mainly an ionomer resin, and a mixture of these. As the rubber composition, it is possible to use the base rubbers and their crosslinking compounds (organic peroxide, and unsaturated carboxylic acid or its metal salt) as described with respect to the materials of the center core 1. In order that the r.d. preventing layer 3 has a hardness exceeding 85, when the cover 4 has the lowest hardness, it is desirable to use 0.5 to 2.0 weight parts of dicumyl peroxide and 30 to 35 weight parts of zinc acrylate per 100 weight parts of a polybutadiene rubber.

As to the elastomer composition, the thermoplastic elastomers indicated as raw material for the core enclosing layer 2 can be used. To attain a hardness exceeding 85, it is desirable to use an elastomer having a high hardness, such as polyamide elastomers.

As to the ionomer composition, the main component of ionomer may be preferably comprised of a metal ion neutralized copolymer synthesized by $\alpha$-olefin and $\alpha,\beta$-unsaturated carboxylic acid. Examples of a metal ion for neutralizing a copolymer are monovalent metal ions such as sodium ion, potassium ion and lithium ion; bivalent metal ions such as zinc ion, calcium ion, magnesium ion, copper ion and manganese ion; and trivalent metal ions such as aluminum ion and neodymium ion. Preferred are sodium ion, lithium ion and magnesium ion because they produce hard ionomers having high hardness and coefficient of restitution. But it is not limited thereto.

If a mixed composition in which rubber, an ionomer and a thermoplastic elastomer are present in proper proportions can satisfy the above-mentioned hardness, such a mixed composition may be used. It is desirable to use a composition comprising mainly an ionomer, in order to obtain a material having a high hardness of not less than 85, and preferably not less than 97.

The cover 4 is required to have such a hardness that it is possible to ensure durability and resist scuffing of a golf ball and also to improve shot feeling upon use of putters, because a necessary coefficient of restitution is ensured by the r.d. preventing layer 3. Specifically, JIS-C hardness of the cover 4 is preferably not less than 85, and about 3 to 10 lower than that of the r.d. preventing layer 3 (when the layer 3 has a JIS-C hardness of 97, a suitable hardness of the cover 4 is from 94 to 87). Thickness of the cover 4 is preferably from 1.0 to 2.5 mm. Below 1.0 mm, it is susceptible to the influence of the r.d. preventing layer 3 with high hardness, resulting in a poor shot feeling upon use of putters. Above 2.5 mm, the cover 4 may become too thick to obtain a sufficient effect by the r.d. preventing layer 3. This lowers the coefficient of restitution of a golf ball, thus decreasing flying distance.

As to the material of the cover 4, no special limitations are imposed thereon, and any materials satisfying the above-mentioned requirements are useable. For example, a balata cover and an ionomer cover may be used. Preferred is the ionomer cover because of its excellent strength. The ionomers described with respect to the r.d. preventing layer 3 may be used as a cover material. A preferable ionomer is zinc ion neutralized coplymer because of the great bonding power of metal ion aggregates and a small reduction in mechanical strength based on the dispersion of crosslinked dien rubber particles.

The cover 4 may comprise mainly the above ionomer and contain, if necessary, additives such as colorant, antioxidant, plasticizer, dispersant and ultraviolet absorbent.

Figure 2:
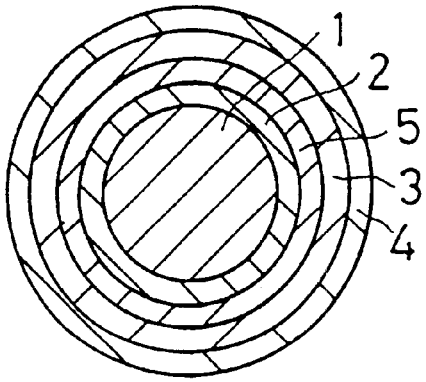
FIG. 2 is a schematic diagram illustrating the structure of a five-piece golf ball according to other preferred embodiment of the present invention.

Although a four-piece golf ball of multi-piece golf balls of the present invention is described by referring to FIG. 1, an interposing layer 5 may be disposed between the core enclosing layer 2 and the r.d. preventing layer 3, as shown in FIG. 2. Further two or more interposing layers may disposed between them. In these multi-piece golf balls, taking the relationship with the center core 1 and the cover 4 into consideration, a thickness of interposing layers disposed therebetween (the sum of thickness of the core enclosing layer 2 and the r.d. preventing layer 3 in the case of four-piece golf balls, and, when an interposing layer 5 is present, the thickness of the layer 5 should be added to the above sum) is preferably from 4.35 to 5.85 mm. The overall hardness of intermediate layers disposed between the center core 1 and the cover 4 is preferably from 50 to 100 in JIS-C hardness.

In producing a golf ball of the present invention, a core composition is subjected to press cure molding to prepare a center core 1, and then a core enclosing layer 2, a r.d. preventing layer 3 and a cover 4 are formed in a covering fashion in this order. When an interposing layer 5 is present between the core enclosing layer 2 and the r.d. preventing layer 3, formation of the interposing layer 5 is executed between the formation of the core enclosing layer 2 and the covering with the r.d. preventing layer 3.

In forming a core enclosing layer 2, a r.d. preventing layer 3 and a cover 4, the following methods are employed though it depends on their components of layers. When a layer may be molded without vulcanization, the layer is molded by injection molding. Alternatively a method is employed such that the core is enclosed by two pre-formed half cups and the two cups are joined together by press molding. When the layer is molded under vulcanization, the latter method is preferred.

In molding a cover, a plurality of recesses which are generally called dimples are formed on the surface of the cover, and paint finishing, marking stamp, etc. are performed for improving appearance and commercial value, thereby providing a marketable product.

EXAMPLES

Evaluation Methods (1) Trajectory Angle

A W#1 driver with a metal head was attached to a swing robot manufactured by True Temper Co., Ltd., and a golf ball was shot at head speed of 40 m/sec, to measure trajectory angle immediately after shot. Measurements were taken five times for obtaining the mean value.

(2) Spin Quantity

A W#1 driver with a metal head was attached to a swing robot manufactured by True Temper Co., Ltd., and a golf ball was shot at head speed of 40 m/sec, to measure the quantity of back spin immediately after shot. Measurements were taken five times for obtaining the mean value.

(3) Flying Distance

A W#1 driver with a metal head was attached to a swing robot manufactured by True Temper Co., Ltd., and a golf ball was shot at head speed of 40 m/sec, to measure the distance up to a drop point. Measurements were taken five times for obtaining the mean value.

(4) Shot Feeling

Ten professional golfers hit golf balls by a W#1 driver with a metal head, iron and putter, to evaluate their shot feelings according to the following criteria. Of ten evaluations, the commonest one was determined as the shot feeling of the ball. The driver and iron offer the same shot feeling, and the shot feeling with the putter was different from the two.

Mark "◎" means that the impact is extremely small to provide excellent shot feeling;

Mark "○" means that the impact is small to provide good shot feeling;

Mark "Δ" means that the shot feeling is moderate; and

Mark "X" means that the impact is large to give poor shot feeling.

(5) JIS C Hardness

JIS C hardness is measured according to JIS K6301. A JIS C hardness of a center core is determined from the measured surface of the center core. A JIS C hardness of a core enclosing layer is determined from the measured surface of the core enclosing layer which covers the core. A JIS C hardness of a r.d. preventing layer is determined from the measured surface of the r.d. preventing layer which covers the core enclosing layer. When an interposing layer is present between the core enclosing layer and a r.d. preventing layer, a JIS C hardness of the r.d. preventing layer is determined from the measured surface of the r.d. preventing layer. A JIS C hardness of a cover is determined from the surface of the golf ball.

Preparation of Golf Balls

Each of the rubber compositions for the core as indicated in Table 1 (Examples) and Table 2 (Comparative Examples) was kneaded uniformly by a kneading roll. This was firstly subjected to press molding at 140° C. for 25 minutes, and then at 165° C. for 8 minutes, to prepare a spherical solid core having a diameter of 31.9 mm or 33.1 mm. Subsequently, a composition for the core enclosing layer was formed on the surface of the solid core by injection molding, to prepare a core enclosing layer. Thereafter, a r.d. preventing layer and a cover is formed in this order by injection molding, to prepare a four-piece golf ball having a diameter of 42.7 mm. Thickness of the core enclosing layer, the r.d. preventing layer and the cover are as indicated in Tables 3 and 4. The surface of the cover of the obtained four-piece golf ball is subjected to painting, resulting in the finished balls Nos. 1 to 12. According to the measuring methods as described, trajectory angle, spin quantity, flying distance and shot feeling were evaluated. The results are given in Table 3 (Examples) and Table 4 (comparative Examples).

In Tables 1 and 2, employed as "BR" being base rubber is "BR11" which is a cis 1,4-polybutadiene comprising 96% of cis-1,4 linkage, and manufactured by The Nippon Synthetic chemical Industry Co., Ltd.. "DPDS" is a diphenyl disulfide manufactured by Sumitomo Seika chemicals Co., Ltd.. "Estoran ET880" and "Estoran ET890" are polyurethane thermoplastic elastomers which differ in hardness, manufactured by Takeda Birdish Urethane Kogyo Co., Ltd. "Septon HG252" is a styrene thermoplastic elastomer manufactured by Kuraray Co., Ltd. "Himilan 1605" is the product name of an ionomer resin of sodium ion neutralized ethylene-methacrylic acid copolymer, and "Himilan 1706" and "Himilan 1855" are the product name of an ionomer resin of zinc ion neutralized ethylene-methacrylic acid copolymer, manufactured by Mitsui DuPont Polychemical Co., Ltd. "Surlyn 8945" is the product name of an ionomer resin of sodium ion neutralized ethylene-methacrylic acid copolymer, "Surlyn 9945" is the product name of an ionomer resin of zinc ion neutralized ethylene-methacrylic acid copolymer, which are manufactured by DuPont Co., Ltd. "Pebacks 2533S" is a thermoplastic polyamide elastomer manufactured by Toray Industries Inc. "A1010" is a block copolymer manufactured by Daicel Chemical Industries, Ltd, which comprises polystyrene block (referred as "S") as a hard segment and polybutadiene block containing epoxy group (referred as "B") as a soft segment and theses blocks are bonded in the form of S-B-S.

TABLE 1

| | | No. 1 | No. 2 | No. 3 | No. 4 | No. 5 |
|---|---|---|---|---|---|---|
| Core | BR | 100 | 100 | 100 | 100 | 100 |
| | Zinc Acrylate | 13 | 14 | 15 | 15 | 16.5 |
| | Zinc oxide | 36.5 | 36.1 | 35.8 | 35.8 | 29.7 |
| | Antioxidant | 0.5 | 0.5 | 0.5 | 0.5 | 0.5 |
| | Dicumyl peroxide | 2 | 2 | 2 | 2 | 2 |
| | DPDS | 0.5 | 0.5 | 0.5 | 0.5 | 0.5 |
| Core enclosing layer | Elastoran ET880 | 100 | 100 | 100 | — | 100 |
| | Elastoran ET890 | — | — | — | — | — |
| | Cepton HG252 | — | — | — | 100 | — |
| | Tungsten | 15.7 | 15.7 | 15.7 | 34.2 | 15.7 |
| R.D. Preventing Layer | Himilan 1855 | 10 | 10 | 10 | 10 | 10 |
| | Surlyn 9945 | 37 | 37 | 37 | 37 | 37 |
| | Surlyn 8945 | 46 | 46 | 46 | 46 | 46 |
| | Pebacks 2533S | 5 | 5 | 5 | 5 | 5 |
| | A1010 | 2 | 2 | 2 | 2 | 2 |
| Cover | Himilan 1605 | 46 | — | — | 46 | 46 |
| | Himilan 1706 | 30 | — | — | 30 | 30 |
| | Himilan 1855 | 10 | 20 | 30 | 10 | 10 |
| | Surlyn 9945 | — | 32 | 25 | — | — |
| | Surlyn 8945 | — | 30 | 27 | — | — |
| | Pebacks 2533S | 10 | 10 | 10 | 10 | 10 |
| | A1010 | 4 | 8 | 8 | 4 | 4 |

TABLE 2

| | | No. 6 | No. 7 | No. 8 | No. 9 | No. 10 | No. 11 | No. 12 |
|---|---|---|---|---|---|---|---|---|
| Core | BR | 100 | 100 | 100 | 100 | 100 | 100 | 100 |
| | Zinc acrylate | 27.5 | 27.5 | 13 | 13 | 27.5 | 13 | 13 |
| | Zinc oxide | 31.9 | 31.9 | 36.5 | 36.5 | 31.9 | 36.5 | 36.5 |
| | Antioxidant | 0.5 | 0.5 | 0.5 | 0.5 | 0.5 | 0.5 | 0.5 |
| | Dicumyl peroxide | 2 | 2 | 2 | 2 | 2 | 2 | 2 |
| | DPDS | 0.5 | 0.5 | 0.5 | 0.5 | 0.5 | 0.5 | 0.5 |
| Core enclosing layer | Elastoran ET880 | — | 100 | — | 100 | — | — | — |
| | Elastoran ET890 | 100 | — | 100 | — | 100 | — | — |
| | Cepton HG252 | — | — | — | — | — | — | — |
| | Himilan 1855 | — | — | — | — | — | 10 | 30 |
| | Surlyn 9945 | — | — | — | — | — | 37 | 25 |
| | Surlyn 8945 | — | — | | — | | 46 | 27 |
| | Pebacks 2533S | — | — | | — | | 5 | 10 |
| | A1010 | — | | — | — | — | 2 | 8 |
| | Tungsten | 15.7 | 15.7 | 15.7 | 15.7 | 15.7 | 34.2 | 34.2 |
| R.D. Preventing Layer | Himilan 1605 | — | — | — | — | 46 | — | — |
| | Himilan 1706 | — | — | — | — | 30 | — | — |
| | Himilan 1855 | 10 | 10 | 10 | 10 | 10 | 30 | 10 |
| | Surlyn 9945 | 37 | 37 | 37 | 37 | — | 25 | 37 |
| | Surlyn 8945 | 46 | 46 | 46 | 46 | — | 27 | 46 |
| | Pebacks 2533S | 5 | 5 | 5 | 5 | 10 | 10 | 5 |
| | A1010 | 2 | 2 | 2 | 2 | 4 | 8 | 2 |
| Cover | Himilan 1605 | — | 46 | 46 | — | — | 46 | 46 |
| | Himilan 1706 | — | 30 | 30 | — | — | 30 | 30 |
| | Himilan 1855 | 10 | 10 | 10 | 10 | 10 | 10 | 10 |
| | Surlyn 9945 | 37 | — | — | 37 | 37 | — | — |
| | Surlyn 8945 | 46 | — | — | 46 | 46 | — | — |
| | Pebacks 2533S | 5 | 10 | 10 | 5 | 5 | 10 | 10 |
| | A1010 | 2 | 4 | 4 | 2 | 2 | 4 | 4 |

TABLE 3

| | | | No. 1 | No. 2 | No. 3 | No. 4 | No. 5 |
|---|---|---|---|---|---|---|---|
| Core | Diameter (mm) | | 31.9 | 31.9 | 31.9 | 31.9 | 33.1 |
| | Hardness (JIS-C) | | 59 | 60 | 61 | 61 | 64 |
| Core Enclosing Layer | Thickness (mm) | | 1.6 | 1.6 | 1.6 | 1.6 | 1.6 |
| | Hardness (JIS-C) | | 45 | 45 | 45 | 42 | 45 |
| R.D. Preventing Layer | Thickness (mm) | | 1.9 | 1.9 | 1.9 | 1.9 | 1.6 |
| | Hardness (JIS-C) | | 97 | 97 | 97 | 97 | 97 |
| Cover | Thickness (mm) | | 1.9 | 1.9 | 1.9 | 1.9 | 1.6 |
| | Hardness (JIS-C) | | 94 | 90 | 89 | 94 | 94 |
| Evaluation | Flight Performance | Trajectory Angle | 13.3 | 13.1 | 13.0 | 13.3 | 13.6 |
| | | Spin | 2470 | 2520 | 2590 | 2580 | 2510 |
| | | Flying distance | 203.9 | 203.8 | 203.5 | 203.4 | 204.1 |
| | Shot Feeling | Driver, Iron | ○ | ◎ | ◎ | ○ | ○ |
| | | Putter | ○ | ◎ | ◎ | ○ | ○ |

TABLE 4

| | | | No. 6 | No. 7 | No. 8 | No. 9 | No. 10 | No. 11 | No. 12 |
|---|---|---|---|---|---|---|---|---|---|
| Core | Diameter (mm) | | 31.9 | 31.9 | 31.9 | 31.9 | 31.9 | 31.9 | 31.9 |
| | Hardness (JIS-C) | | 78 | 78 | 59 | 59 | 78 | 59 | 59 |
| Core Enclosing Layer | Thickness (mm) | | 1.6 | 1.6 | 1.6 | 1.6 | 1.6 | 1.6 | 1.6 |
| | Hardness (JIS-C) | | 53 | 45 | 53 | 47 | 53 | 97 | 89 |
| R.D. Preventing Layer | Thickness (mm) | | 1.9 | 1.9 | 1.9 | 1.9 | 1.9 | 1.9 | 1.9 |
| | Hardness (JIS-C) | | 97 | 97 | 97 | 97 | 94 | 89 | 97 |
| Cover | Thickness (mm) | | 1.9 | 1.9 | 1.9 | 1.9 | 1.9 | 1.9 | 1.9 |
| | Hardness (JIS-C) | | 97 | 94 | 94 | 97 | 97 | 94 | 94 |
| Evaluation | Flight Performance | Trajectory Angle | 12.1 | 12.2 | 12.8 | 13.4 | 12.3 | 12.4 | 12.8 |
| | | Spin | 2900 | 2800 | 2500 | 2580 | 2830 | 2680 | 2610 |
| | | Flying distance | 201.8 | 202.1 | 202.1 | 203.5 | 202.0 | 201 | 202.3 |

TABLE 4-continued

| | | No. 6 | No. 7 | No. 8 | No. 9 | No. 10 | No. 11 | No. 12 |
|---|---|---|---|---|---|---|---|---|
| Shot Feeling | Driver, Iron | X | X | Δ | Δ | X | X | X |
| | Putter | X | ○ | ○ | X | X | ○ | ○ |

As can be seen from Nos. 6, 7 and 10, a higher core hardness results in a worse shot feeling with the drivers and irons. Although Nos. 11 and 12 have a soft core, both are poor in shot feeling because of their hard core enclosing layers. A comparison of Nos. 1–5 with Nos. 9–10 indicates that even when the softness of the core is almost the same, the shot feeling with the driver and iron is unsatisfactory unless the core is covered with a core enclosing layer which is extremely soft, namely, a hardness of not more than 45.

As to the shot feeling with the putter, the shot feeling is fine even if the core is hard, in some cases (for example, a comparison of No. 6 with No. 7). This shows that shot feeling exclusively depends upon the hardness of the cover which is the surface layer of the golf ball, and that shot feeling become poor when the cover has a hardness exceeding 94 (see Nos. 6, 9 and 10).

A comparison of No. 1 with No. 9 indicates that in the presence of a hard r.d. preventing layer, the hardness of the cover does not exert as much influence on flying distance. On the other hand, when the hardness of a r.d. preventing layer is low, as is the case with No. 11, it is impossible to increase flying distance even when the cover is almost the same as Examples, alternatively, when a core enclosing layer is hard.

When the hardness of the core is high as is the case with Nos. 6, 7 and 10, although they have a hard r.d. preventing layer, the trajectory angle is slightly smaller because the quantity of deformation of the ball is small and the quantity of spin is increased. However, the ball is caught in wind and thus fails to increase flying distance. Also, in Nos. 8 and 12, the hardness of the core is not so high, but the hardness of the core enclosing layer is high and the quantity of deformation of the ball is small. As a result, the quantity of spin becomes too great and thus fails to increase flying distance, although trajectory angle is low.

Thus, it appears that flying distance is ensured without increasing the quantity of spin to excess, by arranging such that a core and core enclosing layer are soft to a certain degree and a hard r.d. preventing layer is present.

In addition, further improvements in shot feeling upon use of any kind of clubs of the putters, drivers and irons, are attained without loss of flying distance (see Nos. 2 and 3), by reducing the hardness of the cover within the specified range of the present invention while holding the hardness of a r.d. preventing layer at high values. In other words, when the hardness of r.d. preventing layer is greater than that of cover by 7 or more, a more excellent shot feeling results.

As described, the multi-piece golf balls of the present invention maintain high coefficient of restitution inherent in two-piece golf balls and, at the same time, provide excellent shot feeling when the shot was made by clubs at high head speed, such as drivers and irons, as well as when the shot was made by clubs at low head speed, such as putters. Therefore, players poor in power can expect excellent flying distance by using a multi-piece golf ball of the present invention, without receiving a great impact at shot.

While the present invention has been shown and described in detail, the foregoing description is in all aspects illustrative and not restrictive. It is therefore understood that numerous modifications and variations can be devised without departing from the scope of the present invention.

What is claimed is:

1. A multi-piece golf ball comprising:

a center core having a JIS-C hardness of 55 to 65;

a cover having a JIS-C hardness of 87 to 94;

a core enclosing layer which directly encloses said center core and has a JIS-C hardness in the range of 30 to 45; and a r.d. preventing layer which prevents a restitution coefficient degradation, the r.d. preventing layer being internally disposed in direct contact with said cover and having a JIS-C hardness greater than the others and not less than 97, wherein the core enclosing layer has a JIS-C hardness lower than the JIS-C hardness of the center core, the cover, and the r.d. preventing layer.

2. A multi-piece golf ball according to claim 1, wherein the the core has a diameter of from 29 mm to 38 mm, the core enclosing layer has a thickness of from 0.5 mm to 2.0 mm, the r.d. preventing layer has a thickness of from 1.0 mm to 2.5 mm, and the cover has a thickness of from 1.0 mm to 2.5 mm.

3. A multi-piece golf ball according to claim 1, further comprising an interposing layer between the core enclosing layer and the r.d. preventing layer, the sum of thickness of the core enclosing layer, the interposing layer and the r.d. preventing layer being from 4.35 mm to 5.85 mm.

4. A multi-piece golf ball according to claim 3, wherein the core enclosing layer, the interposing layer and the r.d. preventing layer have a JIS-C hardness of from 50 to 100, as a whole.

5. A multi-piece golf ball comprising a center core, a core enclosing layer enclosing said center core, an inner cover layer covering said core enclosing layer, and an outer cover layer covering said inner cover layer, wherein said center core has a JIS-C hardness of from 55 to 65, said core enclosing layer has a JIS-C hardness of from 30 to 45, said inner cover layer has a JIS-C hardness of not less than 97, and said outer cover layer has a JIS-C hardness of from 87 to 94.

6. A multi-piece golf ball according to claim 5, wherein the center core has a diameter of from 29 mm to 38 mm, the core enclosing layer has a thickness of from 0.5 mm to 2.0 mm, the inner cover layer has a thickness of from 1.0 mm to 2.5 mm, and the outer cover layer has a thickness of from 1.0 mm to 2.5 mm.

7. A multi-piece golf ball according to claim 5, wherein the core comprises a vulcanized rubber composition containing a base rubber, an organic peroxide, and an unsaturated carboxylic acid or metal salt thereof, the core enclosing layer mainly comprises a thermoplastic elastomer, the inner cover layer mainly comprises an ionomer resin, and the outer cover layer mainly comprises a mixture of an ionomer resin and a thermoplastic elastomer.

8. A multi-piece golf ball according to claim 6, wherein the core comprises a vulcanized rubber composition containing a base rubber, an organic peroxide, and an unsaturated carboxylic acid or metal salt thereof, the core enclosing layer mainly comprises a thermoplastic elastomer, the inner cover layer mainly comprises an ionomer resin, and the outer cover layer mainly comprises a mixture of an ionomer resin and a thermoplastic elastomer.

* * * * *